US005778470A

United States Patent [19]

Haider

[11] Patent Number: 5,778,470

[45] Date of Patent: Jul. 14, 1998

[54] PARTITIONED THERAPEUTIC PILLOW WITH BEAD FILLING

[76] Inventor: Thomas T. Haider, 2357 Knob Hill Dr., Riverside, Calif. 92506

[21] Appl. No.: 843,815

[22] Filed: Apr. 21, 1997

[51] Int. Cl.[6] ..... A47G 9/00

[52] U.S. Cl. ..... 5/645; 5/644; 5/655.4; 5/911

[58] Field of Search ..... 5/645, 644, 636, 5/911, 702, 655.4, 637, 640, 643

[56] References Cited

U.S. PATENT DOCUMENTS

| | | | |
|---|---|---|---|
| 774,996 | 11/1904 | Starkwather | 5/645 |
| 2,944,266 | 7/1960 | Wertheiner | 5/645 |
| 2,956,291 | 10/1960 | Hauptman | 5/636 |
| 3,443,267 | 5/1969 | Schuckman | 5/645 |
| 3,762,404 | 10/1973 | Sakita | 5/911 |
| 3,968,530 | 7/1976 | Dyson | 5/911 |
| 4,139,920 | 2/1979 | Evans | 5/911 |
| 4,163,297 | 8/1979 | Neumark | 5/911 |
| 4,607,403 | 8/1986 | Alivizatos | 5/911 |
| 5,079,787 | 1/1992 | Pollmann | 5/655.4 |
| 5,363,524 | 11/1994 | Lang | 5/644 |
| 5,375,278 | 12/1994 | Van Winkle | 5/644 |
| 5,421,874 | 6/1995 | Pearce | 5/911 |

FOREIGN PATENT DOCUMENTS

| | | | |
|---|---|---|---|
| 1273259 | 5/1972 | United Kingdom . | |
| 1344036 | 1/1974 | United Kingdom | 5/636 |

*Primary Examiner*—Alexander Grosz
*Attorney, Agent, or Firm*—Harold L. Jackson

[57] ABSTRACT

A pillow structure formed with an outer cover or casing in which a foam shell is enclosed, where in a horizontally disposed partition being mounted in the shell along the horizontal central axis of the pillow structure, wherein the partition controls the random movement of beads enclosed within each compartment defined by the partition, whereby the beads are prevented from moving or being transferred between the respective juxtaposed compartments.

16 Claims, 2 Drawing Sheets

PARTITIONED THERAPEUTIC PILLOW WITH BEAD FILLING

BACKGROUND OF THE INVENTION

1. Field of the Invention

The present invention relates to a pillow which will conform to a persons's head and neck region for reducing strain on the upper spine during sleep and more particularly to such a pillow that incorporates small expanded beads therein which can move relative to an outer cover to adapt to the configuration of the person's head and neck.

2. Description of the Prior Art

Various types of body support devices such as pillows and mattresses have incorporated small particles such as beads therein to adapt to a user's body.

However, various problems and difficulties have been encountered in providing a suitable means for controlling the displacement of various types of beads stored in pillows. This displacement causes bunching up around the head of the user as well as poor spinal support when one's head is allowed to sink within the beaded support structure of the pillow. It is an inherent problem with pillows and similar supporting devices that are stuffed with beads to allow unrestricted movement or displacement of the loose beads within a pillow casing, causing them to readily shift relative to each other when subjected to an external force. The irregular displacement of the beads often creates a negative effect on the body of a person and more particularly in the cervical area of the neck and/or head area as one lies in an uncomfortable position on the pillow. It can be readily understood that uneven conditions, particularly when deep depressions or pockets are formed in the surface of a pillow, can have serious physical consequences, especially for young children as well as the elderly.

The following patents are examples of various types of body support devices and structures such a pillows, mattresses and pads.

In U.S. Pat. No. 3,968,530 issued to R. Dyson, et al., there is disclosed a body support means that includes aggregates containing a highly viscous gel-like fluid and a mixture of re-expanded polystyrene beads and silica beads which are utilized to produce lightweight pads and mattresses.

In U.S. Pat. No. 4,139,920 issued to F. T. Evans, there are disclosed polymorphic support systems that include a plurality of support elements wherein each element is a closed flexible bag partially filled with a plurality of beads characterized as capable of free flow with respect to each other within the bag when subjected to the weight of a body member.

In U.S. Pat. No. 4,607,403 issued to M. A. Alivizatos, there is disclosed a patient and infant support pad and a bolster wherein each is formed with a flexible closed cover of generally rectangular configuration forming a chamber which is filled with relatively small expanded polystyrene beads that are free to flow within the interior of the sack or cover.

In U.S. Pat. No. 5,079,787 issued to H. P. M. Pollmann, there is disclosed a pressure equalizing support structure that comprises an enclosure filled with a large number of loose pieces that are surrounded by a low-friction deformable material, preferably a foam material.

In U.S. Pat. No. 5,363,524 issued to G. E. Lang, there is disclosed a multi-adjustment cervical pillow which is adjustable to maximize comfortable support of the cervical area of the neck and head, and includes a cover comprising upper and lower fabric cover panels forming therebetween an interior space filled with a flowable filler material.

In U.S. Pat. No. 5,375,278 issued to T. A VanWinkle, et al., there is disclosed a therapeutic pillow having a removable washable outer sleeve. The pillow has a bag-like cover filled with natural granular material having a water content in the range of 5% to 25% by weight, whereby the therapeutic pillow can either be heated or cooled to relieve bodily pain and promote comfort.

In U.S. Pat. No. 5,421,874 issued to T. M Pearce, there is disclosed a composite microspheres and lubricant mixture in a quantity sufficient to substantially coat the exterior surface of essentially all hollow spherical objects which are adapted to be used for seat cushions or bed pads.

SUMMARY AND OBJECTS OF THE INVENTION

The present invention has for an important object to provide two embodiments that comprise a pillow structure adapted to be filled with beads which includes a means defined by a horizontal partition fixedly mounted within the central horizontal plane of the pillow structure to control the movement of the beads within the pillow, whereby a pair of oppositely disposed storage compartments are formed, a selective number of beads being stored in each compartment.

Another object of the invention provides a pillow that includes an outer cover or casing formed from a suitable fabric material having the configuration of a typical elongated pillow and an inner shell that defines an enclosure formed from polyurethane foam which is positioned within the pillow casing.

Still another object of the present invention is to provide a restrictive control means within the shell, wherein the restrictive control means is defined by an inner horizontal partition that is fixedly secured within the shell structure so as to establish two oppositely disposed compartments, whereby the compartments are always positioned one above the other when the pillow is lying in a horizontal position, each compartment being selectively filled with polystyrene beads. Consequently the beads are restricted in their movement within their respective compartment. Thus, the dividing partition separates each compartment one from the other whereby the beads are confined within each respective compartment by means of the structural enclosure of the inner shell.

A further object of the present invention is to provide a pillow structure of this character wherein a suitable soft pliable pillow is defined.

The present invention further provides another embodiment of a pillow structure that includes a compartment inner liner formed from a suitable polyester fabric-like material which reinforces the foam shell.

It is another object of the present invention to provide a pillow of this type, wherein the characteristics of the pillow can be easily and readily adapted for softness or firmness by changing the thicknesses of the material of the foam shell and the compartment inner liner or by simply removing the inner liner.

It is still another object of the invention to provide a pillow of this character that is relatively inexpensive to manufacture and simple in construction.

The characteristics and advantages of the invention are further sufficiently referred to in connection with the accompanying drawings, which represents at least one embodiment. After considering this example, skilled persons will understand that variations may be made without departing from the principles disclosed; and I contemplate the employment of any structures, arrangements or modes of operation that are properly within the scope of the appended claims.

DETAILED DESCRIPTION OF THE PREFERRED EMBODIMENTS

Figure 1:
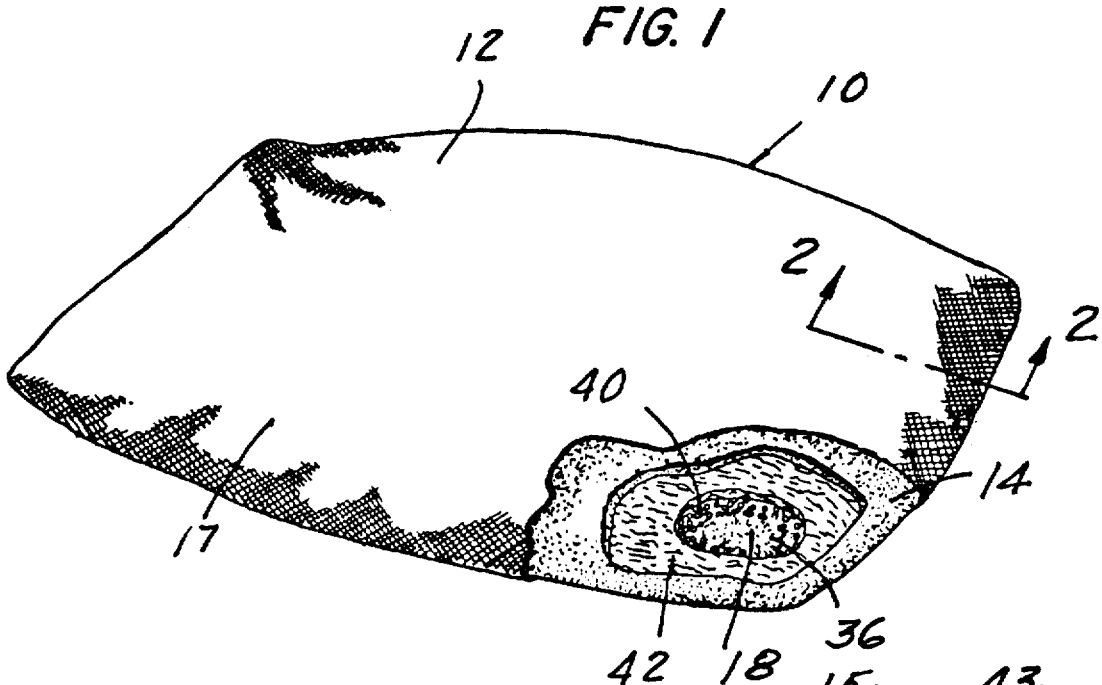
FIG. 1 is pictorial view of the present invention, wherein a portion thereof is broken away to illustrate the various layers of materials that comprise the structure of the pillow.
Figure 2:
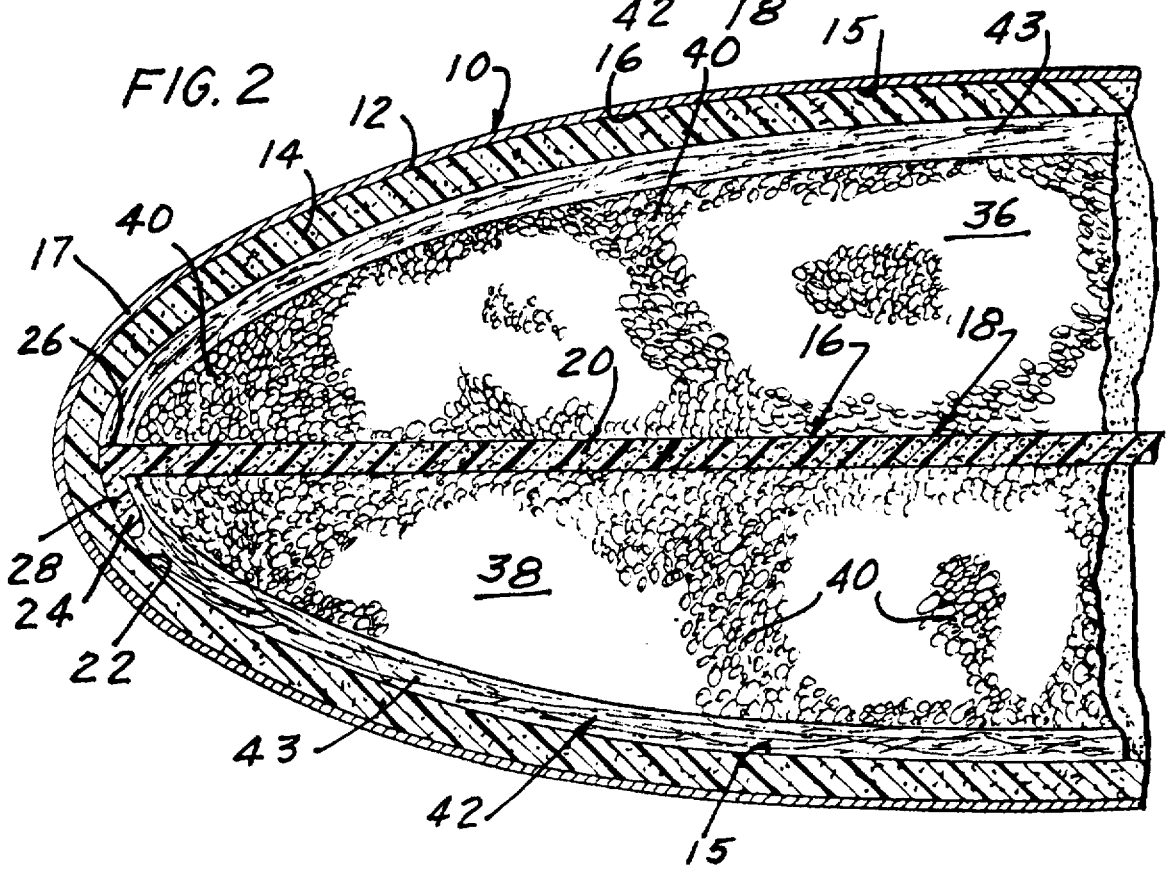
FIG. 2 is an enlarged cross-sectional view taken substantially along line 2—2 of FIG. 1 illustrating the structural arrangement of the pillow and the central horizontal plane of the partition mounted within the interior of the foam shell defining a pair of oppositely disposed compartments which are sealed one from the other.

Referring now in more detail to FIGS. 1 and 2, there is illustrated a first embodiment of a pillow structure which is generally indicated at 10, wherein the pillow structure comprises an outer cover or casing 12 formed from a suitable soft cloth fabric.

Disposed within the outer cover or casing 12 is an inner shell 14 that consists of a polyurethane foam sheet which is positioned under and adjacent to the inner surface 15 of the outer casing 12. The outer cover 12 is similar to known types of pillow casings but is sealed to enclose the inner shell 14, whereby cover 12 defines an outer housing 17 in which inner shell 14 is disposed. Inner shell 14 is formed from a suitable polyurethane foam material having a thickness of between about ⅛" to ¾" and preferably about ⅛". However, the most suitable thickness would be approximately ⅜of an inch. It should be noted that various thicknesses can be selectively used to determine the softness or firmness of a particular pillow. It should be noted that the casing 12 and the inner foam shell 14 can be bonded together.

Figure 3:
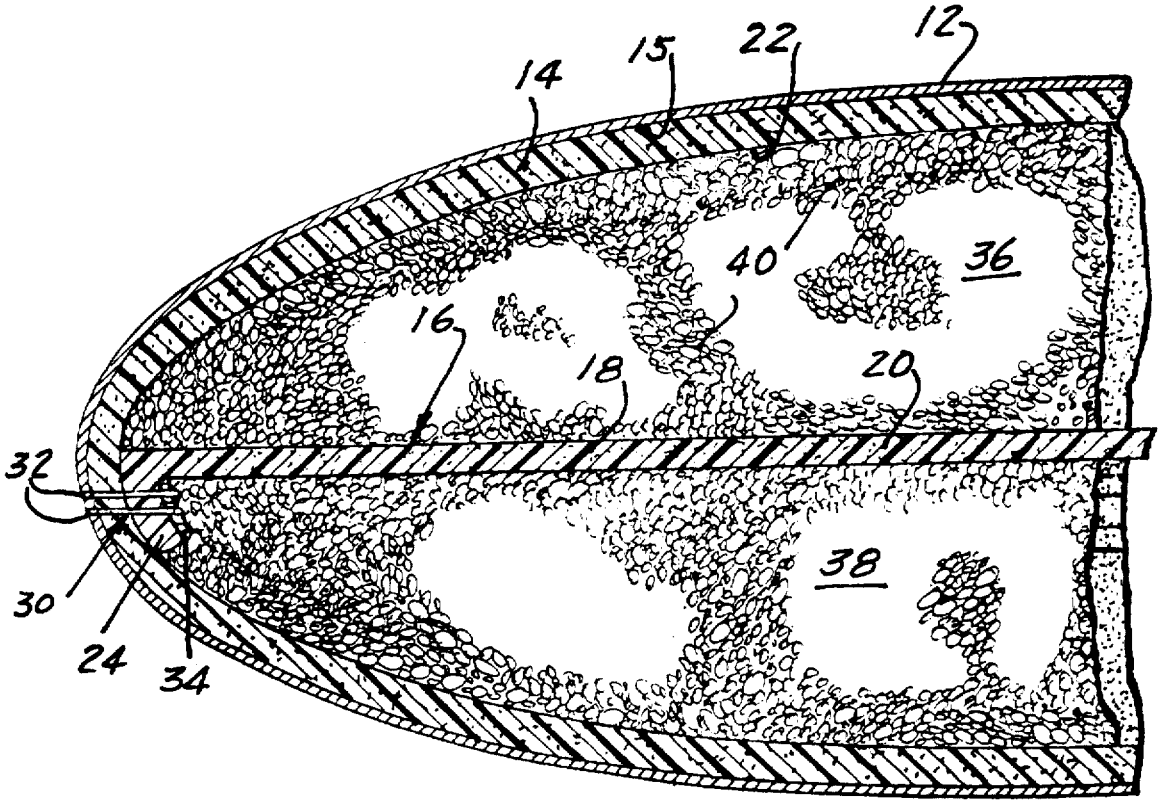
FIG. 3 is an enlarged cross-sectional view of a second embodiment taken substantially along lines similar to that of FIG. 2, wherein this embodiment does not include an inner liner.

Accordingly, the inner shell or enclosure 14 is identical to the pillow-shaped outer cover 12 and includes a restrictive flow control means, generally indicated at 16, which is defined by the partition, designated at 18, which lies in an elongated horizontal plane and suitably mounted along the corresponding horizontal plane of the central portion of the inner shell 14 so as to extend the full length and width of the inner foam shell, whereby each compartment 36 and 38 is sealed with respect to the other. Partition 18 is also formed from a polyurethane foam material identical to the polyurethane foam used for shell 14. In FIG. 2 partition 18 is shown as a substantially flat wall 20 that is arranged to be integrally formed or fixedly secured to the inner surface 22 of shell 14 by means of integrally formed flange members 24 that extend along the full length of peripheral contacting edge 26 of partition 18. The flat wall 20 is illustrated as being secured by a suitable adhesive or bonding agent 28 to the inner surface 22 of the shell. In FIG. 3, the flat wall 20 of partition 18 is illustrated as secured by means of sewing, generally indicated at 30, threads 32 being sewn along the longitudinal flange member 24 which further includes a pair support ribbon 34 (only one of which is shown) positioned on both sides of flange 24, whereby the foam flange is prevented from separating or being torn from the shell 14.

Thus, the elongated partition 18 is secured in place so as to seal each of the oppositely disposed compartments 36 and 38. Each compartment is adapted to have a selective number of beads 40 stored therein. It should be noted that the selective number of beads should not exceed 70 percent of the overall defined volume of each compartment.

Beads 40 are preferably made from an expanded polystyrene material, which is very lightweight, and have a diameter of between about 2 mm to 5 mm. Preferably, each compartment should contain a conglomeration of polystyrene beads having many different sizes. It is important to note that when beads 40 are stored in compartments 36 and 38 they become restricted within their respective compartments, whereby the beads from one compartment are prevented from entering or flowing into the other compartment. This then prevents excessive amounts of beads from being unevenly displaced or accumulated in any area of the pillow at any one time, which would create unsuitable mounds or allow deep hallows to form within the pillow structure. Thus, the overall shape of the pillow will remain fairly constant. This is unlike what is presently found in the related art which teach that beads should be free to move in any direction and do not provide a displacement control means. In the present invention the beads are allowed to move laterally along the length of their respective compartments which permits the pillow to take a configuration or shape more suitable to the force provided by the weight of the user's head and neck that is supported on the pillow.

Within each compartment 36 and 38 there is provided an inner liner 42 which comprises a suitable polyester fabric-like material 43 that preferably includes glass fibers dispersed longitudinally within the fabric which is used to reinforce the polyester material and add strength and stiffness to the pillow structure. Inner liner 42 can be made in any suitable thickness so as to attain the appropriate firmness required for a particular pillow. A suitable thickness can be between an ⅛ of an inch to ¾ of an inch.

A second and preferred embodiment is illustrated in FIG. 3 and is identical to that of the above described pillow structure with the exception that the inner liner 42 is removed and not used.

The foregoing should only be considered as illustrative of the principles of the invention. Further, since numerous modifications and changes may readily occur to those skilled in the art, it is not desired to limit the invention to the exact construction and operation as shown and described, and accordingly, all suitable modifications and equivalents may be resorted to, falling within the scope of the claimed invention.

What is claimed is:

1. A pillow structure comprising:

an outer casing;

an inner shell formed from a resilient material and enclosed in said outer casing;

a pair of juxtaposed compartments in which a multiplicity of polystyrene beads are disposed in;

a horizontal partition secured to the inner surface of said inner shell and defining the juxtaposed compartments to prevent movement of said beads between said compartments and an excess accumulation of beads in a given area of the pillow; and said shell and said partition being formed from a polyurethane foam material.

2. The pillow structure as recited in claim 1, wherein said partition is integrally formed with said shell and wherein said partition is centrally positioned along the longitudinal axis of said shell.

3. The pillow structure as recited in claim 2, wherein said partition has a flange member integrally formed along the peripheral edge of said partition, whereby the partition is fixedly secured to the inner surface of said shell by a bonding means.

4. The pillow structure as recited in claim 2, wherein said partition has a flange member integrally formed along the peripheral edge of said partition, wherein at least one support ribbon is mounted to and sewn along said flange member and said support ribbon so as to be secured to said shell.

5. The pillow structure as recited in claim 1, wherein the thickness of said polyurethane foam material of said shell and said partition is between about ¼ inch and 1 inch.

6. The pillow structure as recited in claim 1, wherein the thickness of said polyurethane foam material is ⅛ inch.

7. The pillow structure as recited in claim 1, wherein a liner is positioned adjacent said inner surface of said shell of each of said compartments.

8. The pillow structure as recited in claim 7, wherein said liner is formed from a polyester material having a thickness of between about ⅛ inch to ¾ inch.

9. The pillow structure as recited in claim 8, wherein the beads are vary in size from about 2 mm to 5 mm in diameter.

10. A pillow structure having means to restrict the movement of a multiplicity of beads stored therein comprising:

an outer pillow cover;

an inner enclosure member formed from a resilient material and mounted within said pillow cover;

a pair of horizontally disposed compartments in which a multiplicity of beads are stored; and a partition positioned centrally along a horizontal plane within the inner enclosure member, thereby forming a horizontal wall between each of said compartments in which said beads are stored, and preventing said beads from moving between said respective compartments, the partition having a flange member integrally formed along the peripheral edge thereof with the flange member being secured to the inner surface of the inner enclosure.

11. The pillow structure as recited in claim 10, wherein said partition is formed from a polyurethane material.

12. The pillow structure as recited in claim 11, wherein a liner is positioned adjacent said inner surface of said inner enclosure so as to be positioned within each of said compartments.

13. The pillow structure as recited in claim 12, wherein said liner is formed from a polyester material having a thickness of between about ⅛ inch to ¾ inch.

14. The pillow structure as recited in claim 13, wherein said beads are formed from a polystyrene material and in a variety of sizes of between about 2 mm and 5 mm.

15. The pillow structure of claim 13 wherein the flange member of the partition is bonded to the inner surface of the inner enclosure.

16. The pillow structure of claim 13 wherein the flange member of the partition is sewn to the inner enclosure.

* * * * *

UNITED STATES PATENT AND TRADEMARK OFFICE

CERTIFICATE OF CORRECTION

PATENT NO. : 5,778,470

DATED : July 14, 1998

INVENTOR(S) : Thomas T. Haider

It is certified that error appears in the above-indentified patent and that said Letters Patent is hereby corrected as shown below:

Column 3, line 39, "3/8of" should read --3/8 of--.

Column 3, line 65, "ribbon" should read --ribbons--.

Column 6, line 23, "13" should read --10--.

Column 6, line 26, "13" should read --10--.

Signed and Sealed this

Fifteenth Day of September, 1998

*Attest:*

*Attesting Officer*

BRUCE LEHMAN

*Commissioner of Patents and Trademarks*